United States Patent [19]

Bamberg

[11] 4,078,389

[45] Mar. 14, 1978

[54] LOST-MOTION REFRIGERATION DRIVE SYSTEM

[75] Inventor: Walter H. Bamberg, Stoughton, Mass.

[73] Assignee: Cryogenic Technology, Inc., Waltham, Mass.

[21] Appl. No.: 809,826

[22] Filed: Jun. 24, 1977

Related U.S. Application Data

[62] Division of Ser. No. 681,936, Apr. 30, 1976.

[51] Int. Cl.[2] ..... F25B 9/00

[52] U.S. Cl. ..... 62/6

[58] Field of Search ..... 62/6; 60/521, 524

[56] References Cited

U.S. PATENT DOCUMENTS

| | | | |
|---|---|---|---|
| 3,312,239 | 4/1967 | Chellis | 62/6 |
| 3,673,809 | 7/1972 | Bamberg | 62/6 |
| 3,698,182 | 10/1972 | Knoos | 62/6 |

*Primary Examiner*—Lloyd L. King

*Attorney, Agent, or Firm*—Griffin, Branigan and Butler

[57] ABSTRACT

Refrigeration systems of the type including first and second communicating, sealed, cylindrical, vessels having respective first and second piston-like elements reciprocating axially therein are characterized by having the vessels positioned in a line along a single axis and having a rod or shaft extending along the axis through a sliding seal for connecting the piston-like elements. A coupling for connecting the rod with one of the piston-like elements allows "lost" axial motion of the rod, without a corresponding motion of the attached piston, over a first portion of the range of axial travel of the rod in both directions. An intercommunicating line is also included for intercommunicating appropriate ends of the elongated vessels.

Such refrigeration systems can operate in various modes of operation, such as stirling-cycle modes of operation, and Vuilleumier-cycle modes of operation.

1 Claim, 10 Drawing Figures

FIG. 6
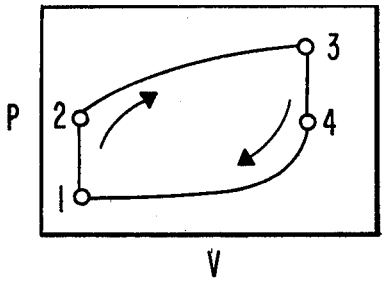
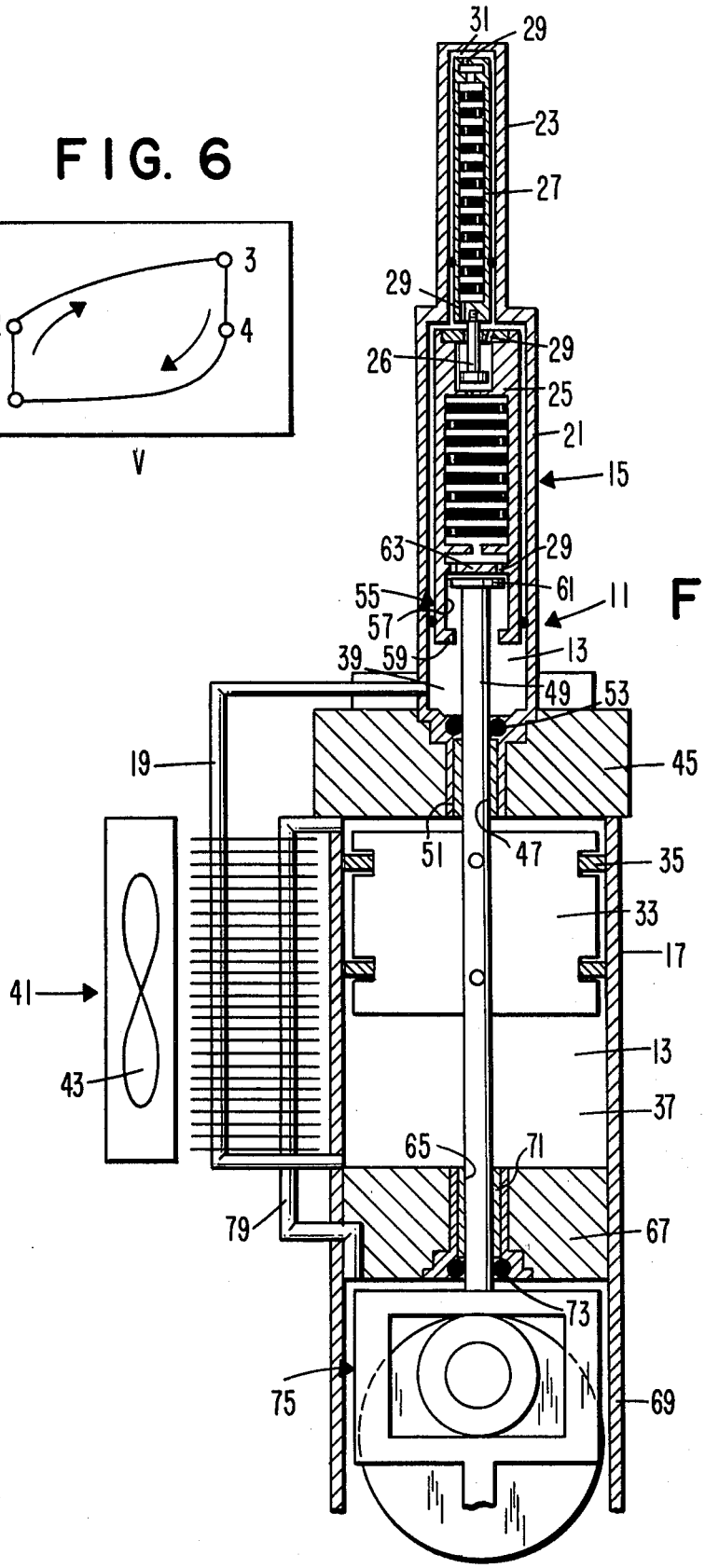
FIG. 1

LOST-MOTION REFRIGERATION DRIVE SYSTEM

This is a division of application Ser. No. 681,936, filed Apr. 30, 1976.

BACKGROUND OF THE INVENTION

This invention relates broadly to refrigeration systems, and more particularly to drive mechanisms for refrigeration systems of the type including two communicating cylindrical vessels having piston-like elements reciprocating therein.

Many refrigeration systems employ a working volume defined by two elongated cylindrical vessels having piston-type elements (displacers and/or pistons) slideably mounted therein making sealing contact with the inner walls thereof. In such systems, regenerators are normally coupled between ends of the working volume (which are also the ends of the cylindrical vessels) and intermediate portions of the working volume. Thus, when the piston-like elements are moved within the cylindrical vessels, refrigerant fluid is driven through the regenerators between the ends of the working volume and the intermediate portions. Refrigeration systems operating in both Stirling and Vuilleumier modes usually have such structures. In the case of Vuilleumier-cycle apparatus, one end of one of the elongated cylindrical vessels (one end of the working volume) is heated and cold is produced at an opposite end of the other elongated cylindrical vessel (the other end of the working volume). In the case of Stirling-cycle apparatus, one of the piston-like elements is a compression piston for producing pressure pulses in the working volume. In both cases, however, the piston-like elements are interconnected by linkages which move them within their respective vessels in appropriate phase relationships to produce cooling.

With regard to an appropriate phase relationship for producing cooling, it can be shown that approximately a 90° phase relationship between an increase in pressure in the working volume and displacer movement from an area of the working volume to be cooled (and a similar phase relationship between a decrease in pressure and displacer movement toward the area to be cooled) will produce cooling at this area. In the case of Stirling-cycle apparatus, the pressure changes are achieved by the compressor piston. In the case of Vuillieumier-cycle apparatus, the pressure changes are achieved thermally by means of movement of a second displacer.

In the prior art, the piston-like elements have been driven by complex mechanisms, such as crank mechanisms disclosed in U.S. Pat. No. 3,862,546 to Daniels and U.S. Pat. No. 3,673,809 to Bamberg (FIGS. 10 and 11). Not only are such mechanisms expensive to manufacture and maintain, since they do not produce straight drives on rods or shafts entering sealed vessels, they cause wear on dynamic seals surrounding the shafts and tend to wear out these seals. Failure of these seals sometimes allows hot gases to by-pass heat exchangers and regenerators to reduce the efficiencies of such systems. Thus, it is an object of this invention to provide a refrigeration system which does not employ complex crank mechanisms for driving piston-like elements of refrigeration systems and which reduces wear on dynamic seals as compared to prior-art systems.

Similarly, it is an object of this invention to provide a linkage between two piston-like elements of a refrigeration system having a force acting substantially only axially, and not laterally, so as to not apply pressure on dynamic seals.

Another problem that exists in the prior art is that with most systems, such as the crank system described above, a driving force can be applied in only one direction for the system to operate. If a crank system is driven in reverse on most Stirling machines, for example, there will be produced a severe heating at the intended "cold end", resulting in rapid, self-destruction of the machine. The reason for this is that the phase relationship between volume and pressure will be reversed. Thus, it is yet another object of this invention to provide a refrigeration system having a linkage between piston-like elements to which energy can be applied in either direction and cooling will still be produced at the intended "cold end. "

SUMMARY

According to principles of this invention, the two piston-like elements in a working-volume of a two-vessel refrigeration system comprises a shaft that is linked to one of the piston-like elements with a "lost" motion connection. Outward motion of the shaft is, at first, not transmitted to the piston-like element but is finally transmitted thereto. Inward motion of the shaft also provides "lost motion" of the shaft before the piston-like element begins to move. The shaft extends through a dynamic seal which separates the two vessels in which the two piston-like elements reciprocate. The two vessels are intercommunicated by an appropriate line.

This system can be used for various modes of operation such as Stirling-cycle modes of operation and Vuilleumier modes of operation.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 1 is an enlarged, schematic, partially-sectional view of a Stirling-cycle embodiment of this invention;

FIG. 6 is a diagramatic representation of a P-V chart illustrating the cycle of operation of both the device of FIGS. 2–5 and the device of FIGS. 7–10.

DESCRIPTION OF THE PREFERRED EMBODIMENT

Figure 2:
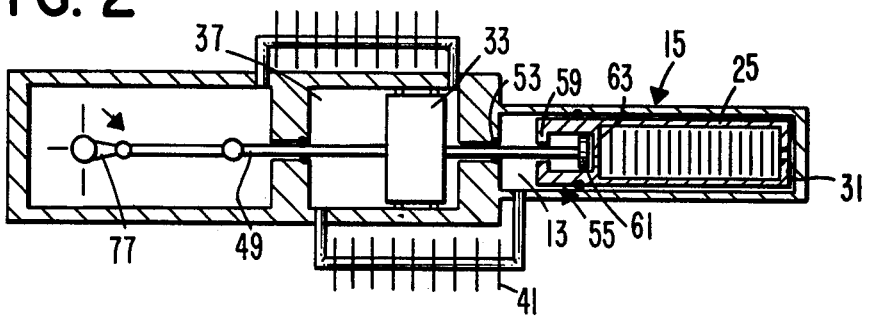
FIGS. 2–5 are schematic sectional views at different stages of operation illustrating an operating cycle of the device of FIG. 1.

With reference to FIG. 1, a Stirling-cycle refrigeration system 11 has a working volume 13 which is defined by a cooling cylinder 15, a compression cylinder 17, and an intercommunicating line 19. The cooling cylinder 15 is actually comprised of a first stage 21, and a smaller second stage 23, however, this feature is not significant with regard to understanding the invention described herein. For further information concerning two stage cooling cylinders reference can be made to U.S. Pat. No. 3,673,809 to Bamberg.

First and second stage displacers 25 and 27 reciprocate respectively in the first and second stage cylinders 21 and 23. In this respect, the second-stage displacer 27 is attached to the first-stage displacer 25 by a lost motion coupling 26, however, again, this is not a part of this invention and therefore not described in further detail herein. These displacers make sliding, sealed contact with their respective cylinders. The first-stage and second-stage displacers 25 and 27 are hollow, although they are partly filled with regenerator material. Thus, these displacers act as regenerators, with refrigerant fluid passing through them via openings 29 at their tops and bottoms. When the displacers are at their uppermost position, as viewed in FIG. 1, there is very little refrigerant fluid located at the top, or cold end 31 of the cooling cylinder 15. However, when the displacers move downwardly, refrigerant passes through regenerator material located in the first-and second-stage displacers 25 and 27 via openings 29 to the cold end 31.

A compression piston 33 having piston rings 35 reciprocates in the compression cylinder 17. The compression piston 33 makes sliding sealed contact with the walls of the compression cylinder 17.

The intercommunicating line 19 joins a working-volume portion 37 of the compression cylinder 17 with an intermediate temperature end 39 of the cooling cylinder 15. A heat exchanger 41, including a fan 43, maintains the temperature of refrigerant passing through the intercommunicating line 19 at the ambience.

The cooling cylinder 15 and the compression cylinder 17 are separated by a sealing wall 45 having an opening 47 therein through which extends a drive shaft 49. The walls of the opening 47 includes a bearing 51 for allowing easy axial movement of the drive shaft 49. Also included is a dynamic seal 53 to prevent the passage of refrigerant fluid through the opening 47 around the drive shaft 49.

The drive shaft 49 is affixed directly to the compression piston 33 but is linked to the first-stage displacer 25 by means of a lost-motion coupling 55. The lost-motion coupling 55 includes a channel 57 formed on the first-stage displacer 25 having a restricted outer end 59, and a flange 61 formed on the outer end of the drive shaft 49. Also, an abutment 63 is formed at the inner end of the channel 57 against which the flange 61 abuts to drive the first-and second-stage displacers 25 and 27 upwardly as viewed in FIG. 1. The flange 61 is free to move in the channel 57 unless it hits the abutment 63 or the restricted outer end 59 at which point it moves the displacer 25 with it.

The drive shaft 49 also extends through an opening 65 in an opposite sealing wall 67 to a crankcase 69. The opening 65 also includes a bearing 71 and a dynamic seal 73. A driving mechanism 75, such as a scotch yoke as is depicted in FIG. 1, or a crank 77 as is depicted in FIGS. 2–5, is located in the crankcase 69 for reciprocating the drive shaft 49 longitudinally, or axially.

In the embodiment of FIG. 1, the crankcase 69 is connected to a non-working-volume portion of the compression cylinder 17 via a line 79 which extends through the heat exchanger 41. Again, this maintains the temperature of gases located in these volumes at the ambience.

Describing the operation of the FIG. 1 embodiment, with reference to FIGS. 2–5, in FIG. 2 the compressor piston 33 is advancing to the left thereby causing a rise in pressure in the compressor head space or working volume portion 37 as well as throughout the whole working volume 13, including the cold end 31 of the cooling cylinder 15. This increased pressure, plus displacer-friction, keeps the displacer 25 at the cold-end 31 of the cooling cylinder 15 (shown in FIGS. 2–5 as having a single cooling stage for the purposes of simplification). This step is illustrated in the P-V diagram FIG. 6 by line 1-2 wherein pressure at the cold end 31 increases as volume remains constant.

Figure 3:
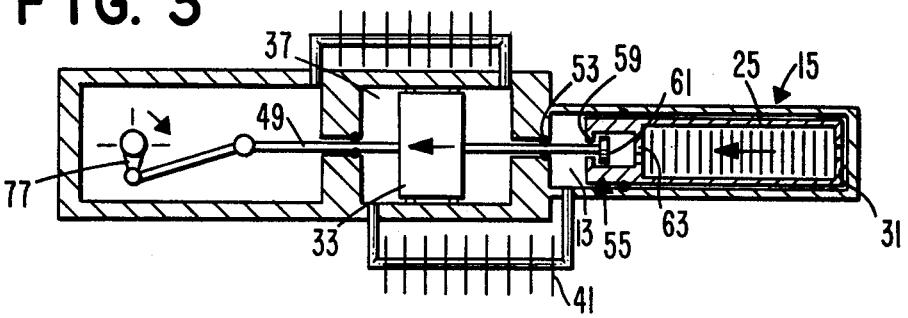

In FIG. 3, the drive shaft 49 continues to move to the left carrying the compressor piston 33 with it. At the point depicted in FIG. 3, the flange 61 makes contact with the restricted outer end 59 of the lost-motion coupling 55. Thus, the displacer 25 is now carried to the left to increase the volume at the cold end 31 approximately 90° behind movement of the compressor piston 33. This step is graphically represented by line 2-3 on the P-V chart of FIG. 6.

Figure 4:
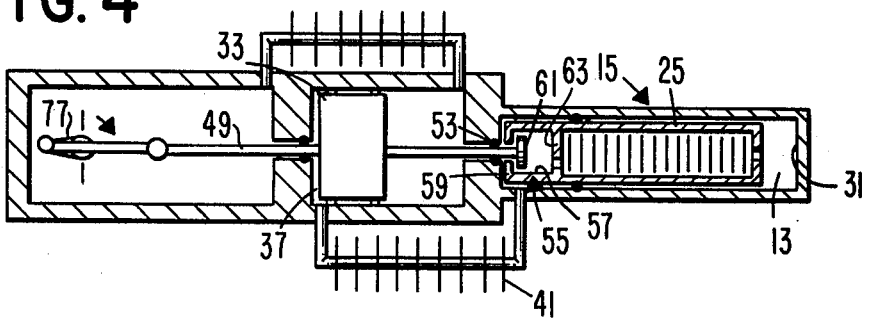

Turning next to FIG. 4, the compressor piston 33 has now begun to recede to the right, thereby increasing the compressor head space or working volume portion 37 and causing a drop in pressure of the refrigerant gas throughout the working volume 13, and in particular at the cold end 31. However, the displacer 25 is not moving in FIG. 4 because the flange 61 is free to move in the channel 57 of the lost motion coupling 55. This step is illustrated graphically in FIG. 6 by line 3-4 wherein the pressure decreases but the volume remains constant.

Figure 5:
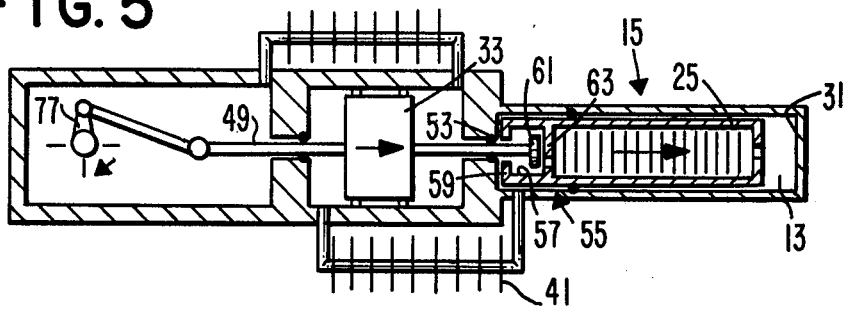

Finally, in FIG. 5, the flange 61 impinges on the abutment 63 to move the displacer 25 to the right and thereby decrease the volume at the cold end 31 while the compressor piston 33 recedes further. This results in a further drop of pressure, accompanied by a decrease in volume at the cold end 31 and sweeps the expanding gas out of the cold end 31. This step is illustrated by line 4-1 in FIG. 6.

One skilled in the art will immediately recognize that the resulting pressure and volume caused by this cycle will create cooling at the cold end 31.

It should be understood by those skilled in the art that the linkage mechanism comprised basically of the drive shaft 49 and the lost motion coupling 55, has a potential for reliability far superior to those of prior art linkages. In this respect there are virtually no forces acting laterally on the drive shaft 49 to cause excessive wear on the dynamic seal 53. It should be appreciated that this linkage system also produces no piston friction other than that of the piston rings. Further, this system is inexpensive to manufacture and easy to repair. Also, there are no complex adjustments.

Still further, it will be readily understood by those skilled in the art that the crank 77 can be driven in either direction and cooling will be produced at the cold end 31.

FIGS. 7 through 10 depict a related refrigeration system for operating in the vuilleumier-cycle mode of operation. In this device, a working volume 81 is defined by a hot vessel 83, a cold vessel 85, and a bypass line 87. The cold vessel 85 has a cold displacer 89 reciprocating therein and the hot vessel 83 has a hot displacer 91 reciprocating therein.

The cold and hot displacers 89 and 91 are linked by a drive rod 93 which is reciprocably driven by a rotated crank 95 interacting with a slot 97 in the drive rod 93. The drive rod 93 has a flange 99 on a cold-displacer end thereof which is positioned in a channel 101 of the cold displacer 89. The channel 101 has a restricted outer end 103 and an abutment 105 at the inner end thereof. Thus, the flange 99 has freedom of movement in the channel 101 until it hits the restricted outer end 103 or the abutment 105 depending on its direction of travel.

Energy is applied to the system in the form of heat by a heater 107. Cold is produced by the system at a cold end 109 of the cold vessel 85. It is possible for the system to be completely driven by the heater 107, however, in most cases, a small bit of energy will be applied to the crank 95 for aiding in movement of the drive rod 93.

The hot and cold displacers 89 and 91 are hollow and have regenerator heat-exchanger material located therein. As they reciprocate in their respective cold and hot vessels 85 and 83 refrigerant fluid located in the working volume 81 passes through holes 111 in the displacers to pass through the regenerator heat-exchanger material.

After-cooler fins 113 are positioned at an intermediate-temperature end of the hot vessel 83 to hold this area to the temperature of the ambience.

Figure 7:
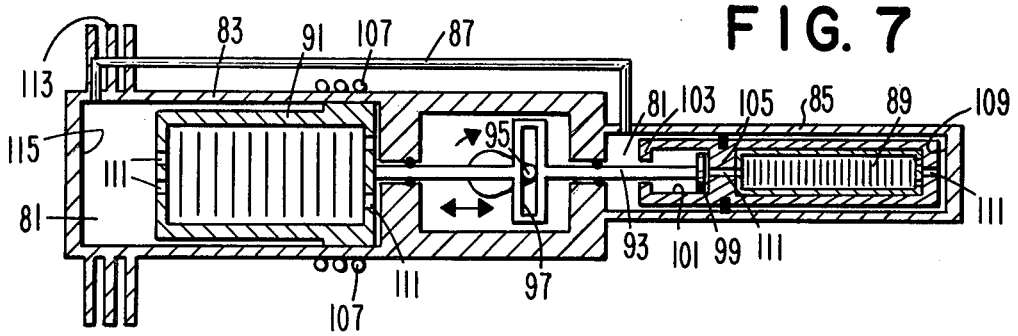
FIGS. 7–10 are schematic-sectional views taken at different stages of an operational cycle of a Vuilleumier-cycle embodiment of this invention.

FIGS. 7–10 shows successive stages or steps of a cycle of operation of the vuilleumier-cycle system. In FIG. 7, the crank 95 is beginning to move the hot displacer 91 to the left in the hot vessel 83. Initially, the cold displacer 89 will not be moved in the cold vessel 85 because the flange 99 will be free to move in the channel 101. As the ambient-temperature refrigerant fluid at the intermediate end 115 of the hot vessel 83 passes through regenerator material in the hot displacer 91 it is heated thereby increasing the pressure in the working volume 81 with the volume in the cold end 109 of the cold vessel 85 remaining constant. This step is represented by line 1-2 in FIG. 6.

It is noted that very little energy must be applied to the crank 95 to move the drive rod 93 inasmuch as the only resistance thereto is a fluid pressure differential across the hot displacer 91 and friction.

Figure 8:
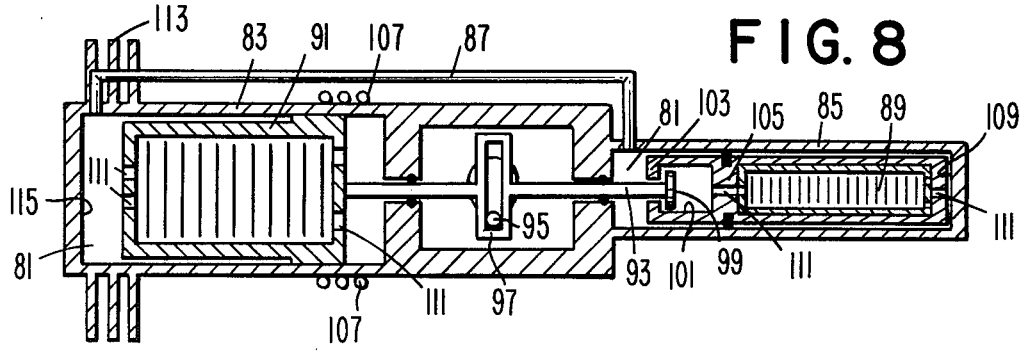

At the step of FIG. 8, the drive rod 93 continues to be driven to the left, but now the flange 99 has contacted the restricted outer end 103 to move the cold displacer 89 away from the cold end 109. The cold displacer 89 is caused to move approximately 90° of the overall cycle behind the movement of the hot displacer 91. As the hot and cold displacers 91 and 89 move to the left, the pressure continues to rise, but at a slower pace because now refrigerant fluid is passing through the regenerator of the cold displacer 89. In addition, the volume at the cold end 109 is increasing. The step of FIG. 8 corresponds to line 2-3 of the FIG. 6 P-V diagram.

Figure 9:
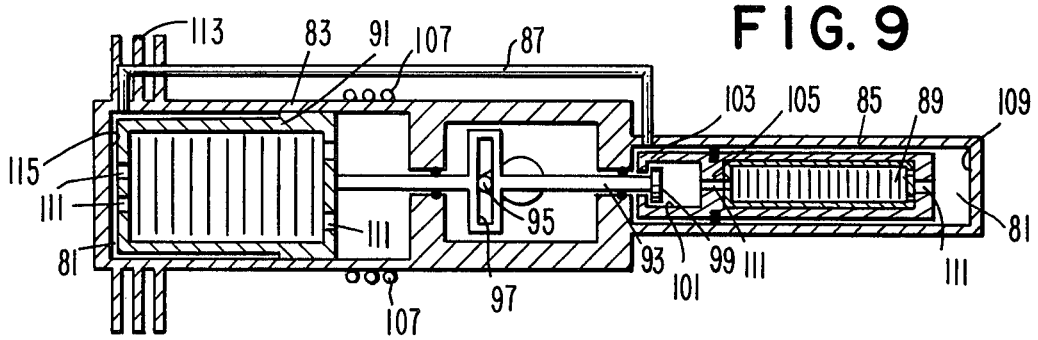

In FIG. 9, the crank 95 is now beginning to urge the drive rod 93 back to the right. In the beginning, only the hot displacer 91 will move and the flange 99 will move in the channel 101. Since hot refrigerant fluids pass through the regenerator material of the hot displacer 91 and are thereby cooled, pressure in the overall working volume 81 decreases. This step corresponds to line 3-4 of FIG. 6 where pressure decreases but volume remains constant.

Figure 10:
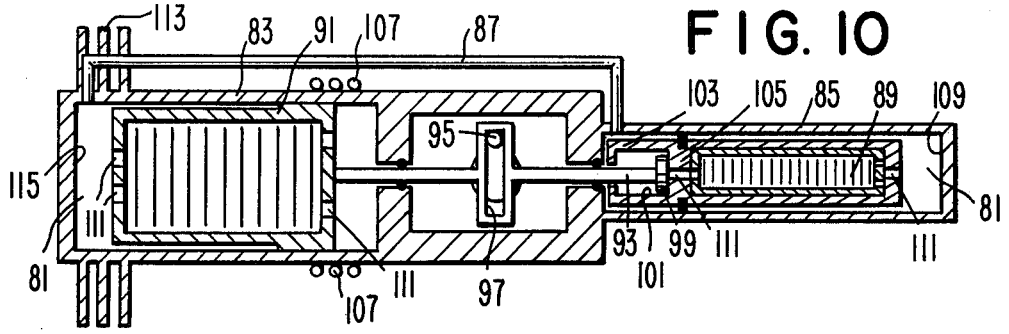

Finally, in FIG. 10 the flange 99 contacts the abutment 105 to drive the cold displacer 89 to the right with further movement to the right of the hot displacer 91. The pressure in the working volume continues to drop, but now at a slower rate since cold refrigerant fluid is passing through the regenerator material of the cold displacer 89 and is being thereby warmed. This step corresponds to line 4-1 of FIG. 6.

It will be appreciated by those skilled in the art that the "lost-motion" linkages described herein promote increased efficiency tending to reduce leaking seals by allowing direct axial application of force to displacer drive rods. In addition, the linkages of this invention are considerably less complicated then most linkages of prior art refrigeration systems.

Finally, drive forces can be supplied to a refrigeration system built in accordance with this invention in either of opposite directions and the system will still produce cooling. This feature provides a safety factor in that application of force in an incorrect direction will not produce self-destruction of the device.

While the invention has been particularly shown and described with reference to a preferred embodiment, it will be understood by those skilled in the art that various changes in form and detail may be made therein without departing from the spirit and scope of the invention. For example, the crank device of FIGS. 7–10 could also be used in the device of FIGS. 1–5.

The embodiments of the invention in which an exclusive property or privilege are claimed are defined as follows:

1. A method of driving the piston elements of interconnected elongated vessels forming a working volume of a refrigeration system comprising the steps of:

aligning the elongated vessels along a single axis so that the piston elements of the elongated vessels move along the single axis;

connecting the piston elements to one another with a rod extending between the piston elements along said axis through a dynamic seal separating the elongated vessels so that the coupling to one of said piston elements allows "lost" axial motion of said rod without a corresponding motion of said one piston over a first portion of the axial travel of said rod in either direction;

applying energy to said rod to reciprocate said rod axially.

* * * * *